US007013841B1

(12) United States Patent
Boros et al.

(10) Patent No.: US 7,013,841 B1
(45) Date of Patent: Mar. 21, 2006

(54) DIFFERENTLY CONFIGURED FUEL-FIRED WATER HEATERS CONSTRUCTED FROM IDENTICAL PRODUCTION PLATFORMS

(75) Inventors: Jozef Boros, Montgomery, AL (US); Subbu Thenappan, Montgomery, AL (US); Walter T. Castleberry, Pike Road, AL (US); Kenneth J. Hicks, Deatsville, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 11/048,247

(22) Filed: Feb. 1, 2005

(51) Int. Cl.
*F24H 9/14* (2006.01)

(52) U.S. Cl. ..... 122/19.2; 122/14.1; 126/344

(58) Field of Classification Search ..... 122/19.2, 122/13.01, 14.1, 494; 126/344; 392/451; 220/567.3, 694.1, 495.01
See application file for complete search history.

(56) References Cited

U.S. PATENT DOCUMENTS

| | | | | |
|---|---|---|---|---|
| 2,334,398 | A * | 11/1943 | Farren et al. | 122/14.1 |
| 2,385,450 | A | 9/1945 | Koppel | |
| 2,428,466 | A | 10/1947 | Palm | |
| 2,563,817 | A | 8/1951 | Carson | |
| 3,707,142 | A | 12/1972 | Kobayashi | |
| 4,148,355 | A | 4/1979 | Gehring | |
| 4,477,399 | A | 10/1984 | Tilton | |
| 4,679,528 | A | 7/1987 | Krans et al. | |
| 4,901,676 | A | 2/1990 | Nelson | |
| 4,940,042 | A | 7/1990 | Moore, Jr. et al. | |
| 4,979,637 | A | 12/1990 | Nelson | |
| 5,020,512 | A | 6/1991 | Vago et al. | |
| RE33,968 | E | 6/1992 | Clark | |
| 5,533,495 | A | 7/1996 | Moore, Jr. | |
| 5,575,273 | A | 11/1996 | Moore, Jr. | |
| 5,697,330 | A | 12/1997 | Yetman et al. | |
| 5,765,547 | A | 6/1998 | La Plante | |
| 5,797,355 | A * | 8/1998 | Bourke et al. | 122/14.21 |
| 6,148,774 | A | 11/2000 | Neill et al. | |
| 6,318,304 | B1 * | 11/2001 | Teschner | 122/18.1 |
| 6,412,447 | B1 | 7/2002 | Trant et al. | |
| 6,622,661 | B1 | 9/2003 | Hotton | |

OTHER PUBLICATIONS

Merloni Quadriga Water Heater Literature (Undated).
Dux Forte Water Heater Pictures and Sketch (Undated).

* cited by examiner

*Primary Examiner*—Gregory Wilson
(74) *Attorney, Agent, or Firm*—Konneker & Smith, P.C.

(57) ABSTRACT

A specially configured fuel-fired water heater production platform may be used as a natural draft water heater. Alternatively, by modifying an upper end portion of the production platform using associated conversion apparatus, the same platform may be converted to a power vented water heater subassembly, a natural draft direct vent water heater subassembly, or a powered direct vent water heater subassembly to thereby lower the overall production costs for these different types of fuel-fired water heaters.

34 Claims, 13 Drawing Sheets

DIFFERENTLY CONFIGURED FUEL-FIRED WATER HEATERS CONSTRUCTED FROM IDENTICAL PRODUCTION PLATFORMS

BACKGROUND OF THE INVENTION

The present invention generally relates to water heaters and, in representatively illustrated embodiments thereof, more particularly relates to unique methods of manufacturing various types of fuel-fired water heaters using a common production platform structure, and water heaters manufactured by such methods.

Modern day fuel-fired water heaters are typically manufactured in several configurations including (1) natural draft water heaters, (2) power vented water heaters, (3) natural draft direct vent water heaters, and (4) powered direct vent-water heaters. Customarily, each of these water heater varieties requires that a differently configured water heater subassembly or "platform" be provided as the constructional basis for the particular water heater variety. This conventional necessity of providing a different manufacturing platform for each of the four water heater varieties normally requires significant changeovers on a single production line or the use of multiple production lines to accommodate the necessary different finished water heater configurations. In either event, the overall production cost of the water heaters is undesirably increased.

As can readily be seen from the foregoing, a need exists for water heater constructions and associated manufacturing methods which eliminate or at least substantially reduce this problem. It is to this need that the present invention is directed.

SUMMARY OF THE INVENTION

In carrying out principles of the present invention, in accordance with representatively illustrated embodiments thereof, several different types of fuel-fired water heaters are constructed using identical production platforms so that manufacturing and tooling costs associated with the water heaters may be reduced.

Representatively, each production platform includes a tank adapted to hold a quantity of water to be heated, a jacket structure extending around the tank and defining therewith an insulation space that laterally circumscribes the tank, the jacket structure having a horizontal top end section extending over the top end of the tank and having a centrally disposed first opening and a peripherally disposed second opening extending downwardly therethrough. Insulation is disposed in the insulation space and extends between the outer side surface of the tank and the inner side surface of the jacket structure, and a combustion chamber is disposed beneath the bottom end of the tank and has a fuel burner operatively associated therewith. A flue extends from the combustion chamber, and upwardly through the interior of the tank, to the first opening in the top jacket structure end section. A combustion air intake passage, representatively defined by a vertical duct, extends downwardly through the insulation and intercommunicates the second jacket structure opening with the interior of the combustion chamber via a plenum structure.

In an embodiment of the production platform the plenum structure is a plenum box structure disposed in the insulation space and extending externally around only a portion of the exterior side wall circumference of the combustion chamber and communicating with the interior of the combustion chamber through an opening in a vertical side wall thereof.

In a first alternate embodiment of the production platform the plenum structure includes a combustion air transfer plenum is disposed beneath the combustion chamber and has a vertical side wall with an air transfer opening formed therein and communicated with the interior of the circumferentially extending air plenum box in the insulation space. Air entering the combustion air transfer plenum from the air plenum box is upwardly transferred into the combustion chamber via a spaced series of air transfer openings in its bottom wall. The bottom combustion chamber wall preferably has a heat reflective top side surface so that radiant combustion heat is reflected upwardly onto the bottom end of the tank during firing of the water heater in which the production platform is incorporated.

In a second alternate embodiment of the production platform, the plenum structure includes an air plenum box structure disposed beneath the bottom wall of the combustion chamber, having an outlet connected to the bottom wall and communicating with the combustion chamber interior through an opening in the bottom wall, and being further communicated with the vertically extending combustion air intake passage. A perforated air distribution plate disposed in the combustion chamber above its bottom wall serves to horizontally distribute the combustion air entering the combustion chamber via the plenum structure.

In a third alternate embodiment of the production platform, the plenum structure includes a plenum pan disposed beneath the balance of the combustion chamber and having a bottom wall defining the bottom wall of the combustion chamber. A perforated air distribution plate extends across the top side of the plenum pan and is disposed beneath the burner. The vertically extending combustion air passage disposed within the water heater jacket insulation space is representatively defined by a vertically extending duct therein which is coupled at its lower end to a side wall opening in the plenum pan.

According to one feature of the invention a radiant heat deflector/air diversion plate structure is mounted in the combustion chamber, below the burner, and is used to divide the combustion air entering the combustion chamber through a side wall opening therein into primary combustion air disposed below the plate and secondary combustion air disposed above the plate. The plate structure also serves to reflect burner flame radiant heat upwardly onto the bottom end wall of the tank to improve the overall thermal efficiency of the water heater.

According to another feature of the invention, a check valve structure is disposed within the vertical combustion air flow passage extending through the tank insulation and functions to substantially prevent undesirable convective air flow upwardly through the passage during standby periods of the water heater, but freely permit combustion air flow downwardly through the passage during firing periods of the water heater.

The production platform may be directly used as a natural draft water heater, and conversion apparatus is provided for alternatively converting the production platform, by modifying a top end portion thereof, to either a power vented water heater, a natural draft direct vent water heater, or a powered direct vent water as desired. When the platform is utilized as either a natural draft water heater or as a power vented water heater, the second top jacket section end opening used as a combustion air inlet is directly exposed to ambient air adjacent a top end portion of the water heater.

The portion of the conversion apparatus useable to convert the production platform to a power vented water heater representatively comprises a draft inducer fan mountable on the top end of the platform and having an inlet communicatable with an upper end portion of the flue.

The portion of the conversion apparatus useable to convert the production platform to a natural draft direct vent water heater representatively includes a cover member having an opening therein and being securable to an upper end portion of the platform in a manner such that the cover member forms a combustion air intake plenum overlying the upper end of the platform and communicating with the vertical insulation space air flow passages. This conversion apparatus portion also includes a concentric tube structure having an inner vent tube outwardly surrounded by an outer combustion air tube forming around the inner vent tube a combustion air passageway, the concentric tube structure being operatively connectable to an upper end portion of the production platform in a manner such that the inner vent tube is coupled to the flue, and the combustion air passageway communicates with the combustion air intake plenum.

The portion of the conversion apparatus useable to convert the production platform to a powered direct vent water heater includes a cover member having combustion air and flue openings therein and being securable to an upper end portion of the production platform in a manner such that the cover member forms a combustion air intake plenum overlying the production platform. This conversion apparatus portion also includes a draft inducer fan having an inlet, and a hollow flow structure, representatively a pair of interconnectable tees, connectable to the cover member in a manner intercommunicating the fan inlet with the flue and the combustion air intake plenum, the hollow flow structure also having a combustion air inlet opening for receiving combustion air for delivery to the combustion air intake plenum. Alternatively, a concentric blower structure having a suitable air flow structure communicating with both the flue and the combustion air intake plenum could be utilized if desired.

DETAILED DESCRIPTION

Figure 1:
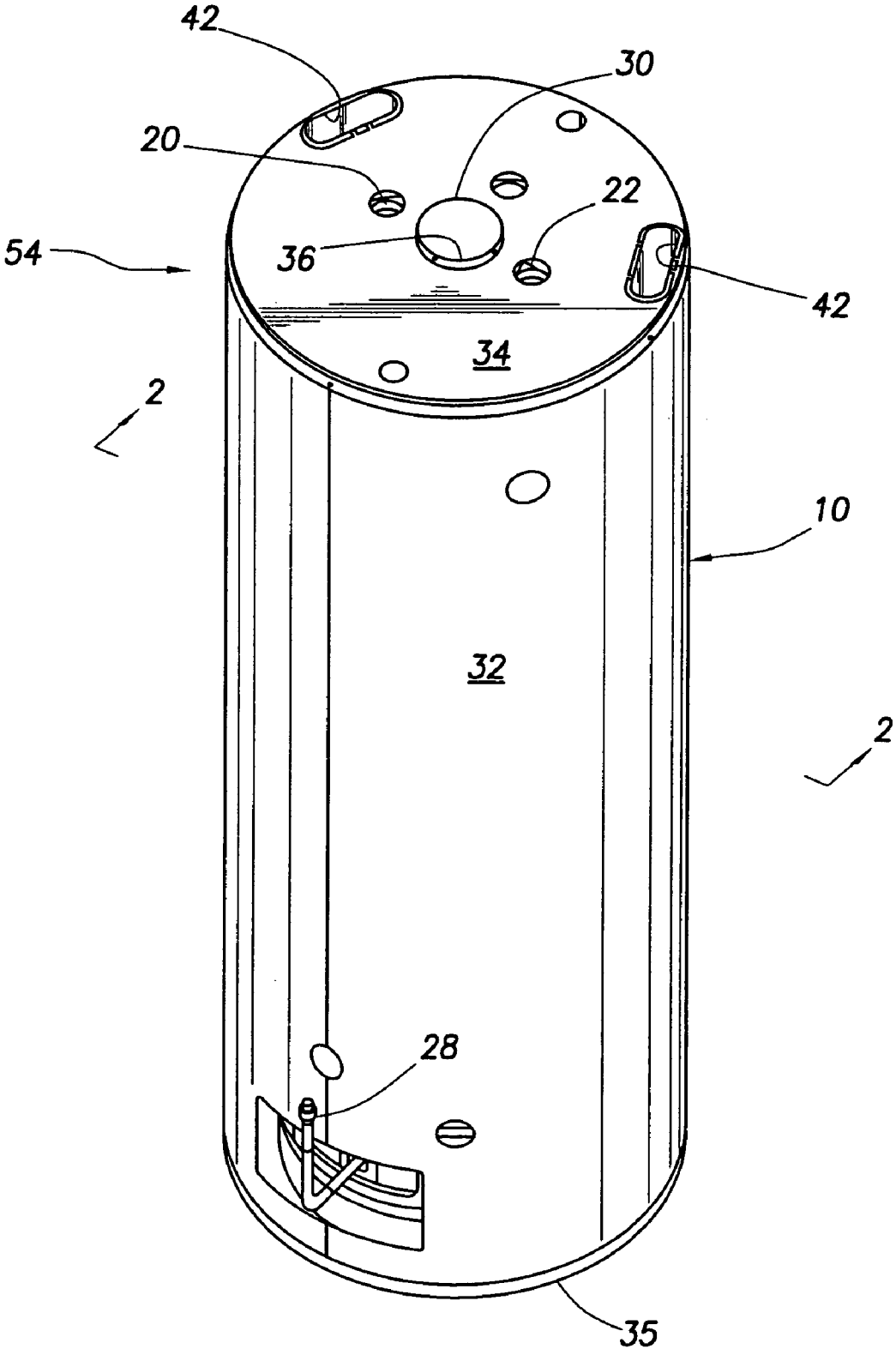
FIG. 1 is a perspective view of a fuel-fired water heater production platform which may be used as a natural draft water heater or, by modifying an upper end portion thereof, be uniquely converted to a power vented water heater subassembly, a direct vent water heater subassembly, or a powered direct vent water heater subassembly.
Figure 2:
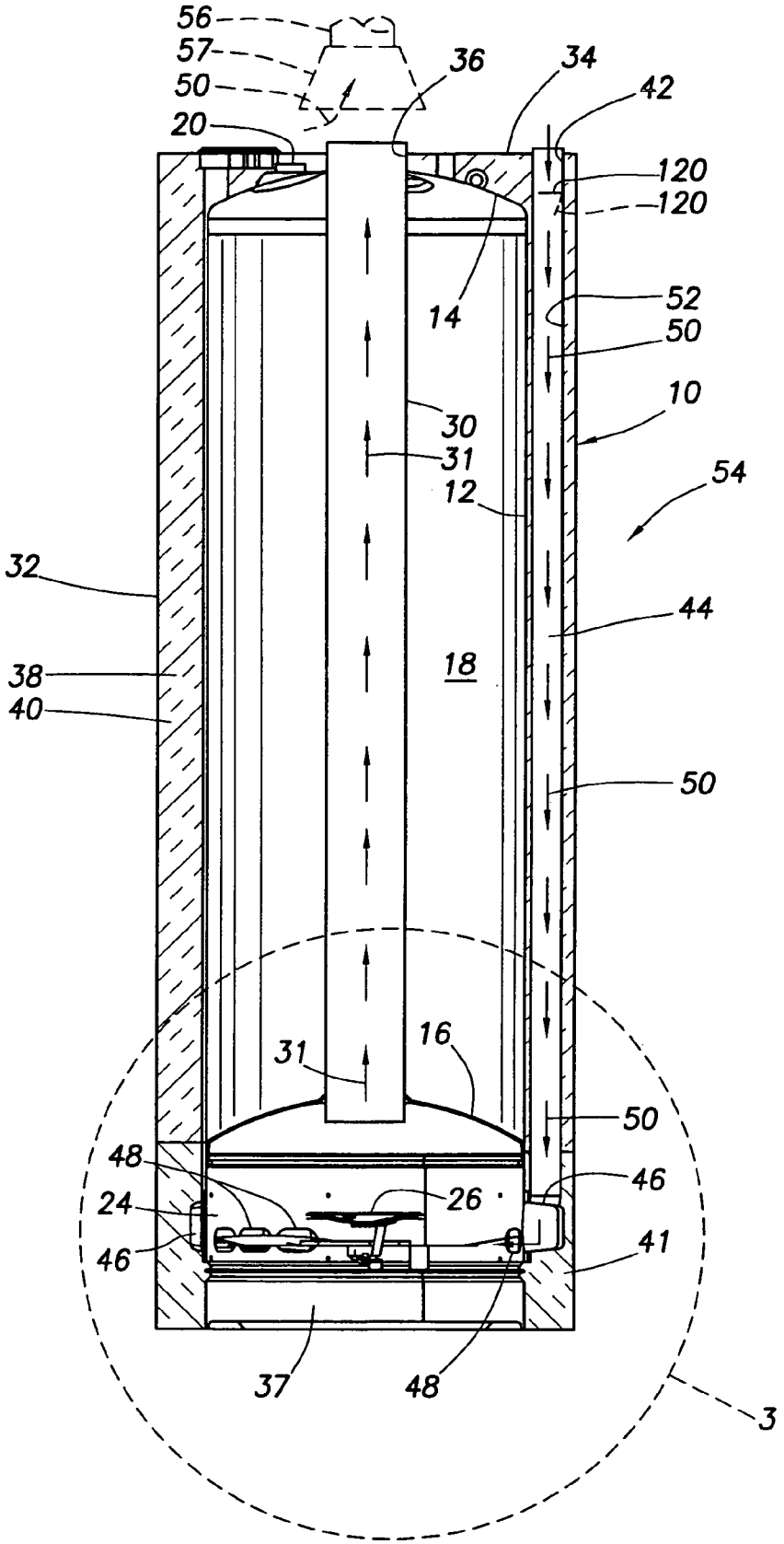
FIG. 2 is a simplified cross-sectional view through the production platform taken along line 2—2 of FIG. 1.
Figure 3:
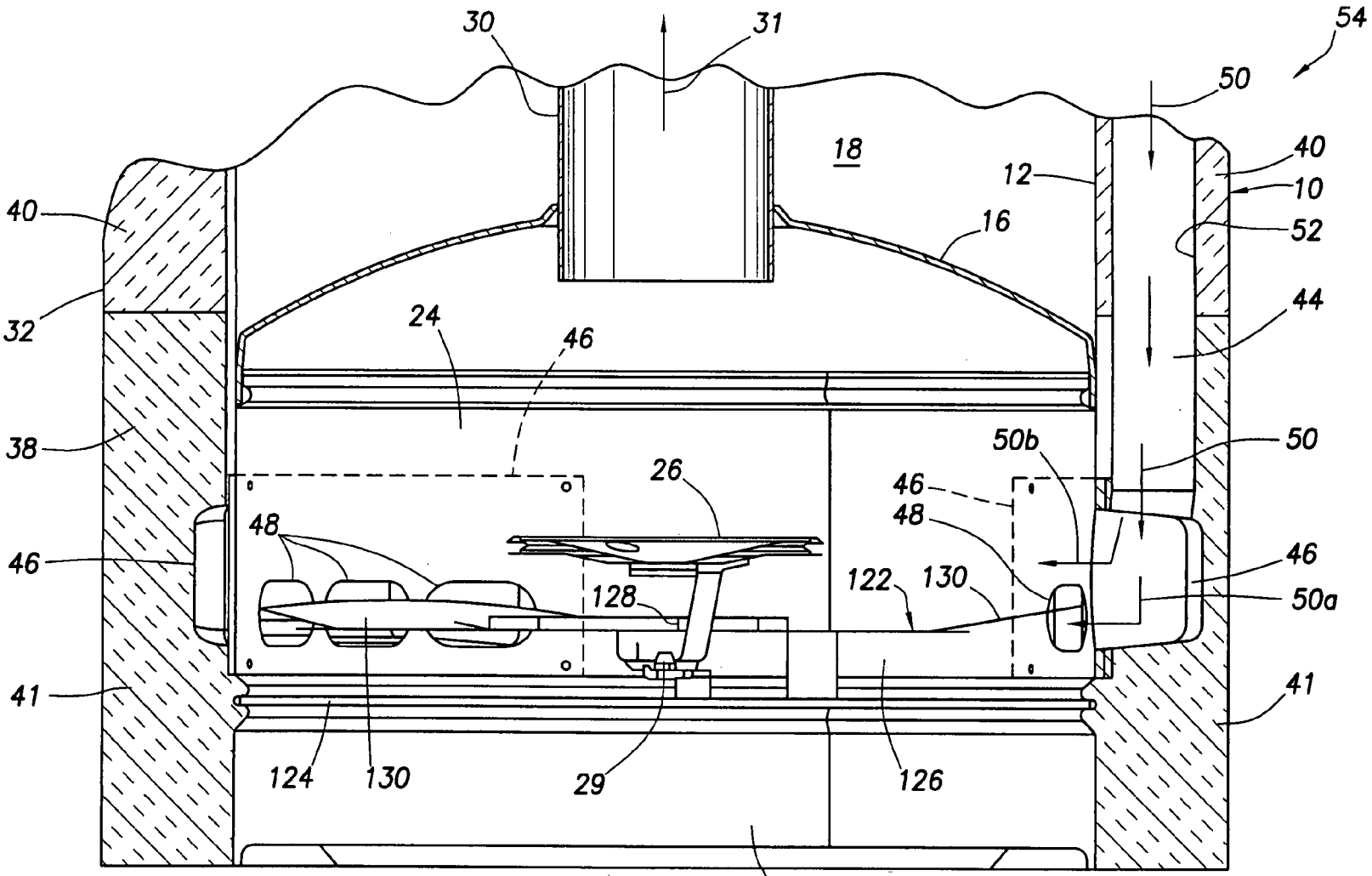
FIG. 3 is an enlarged scale detail view of the dashed circle area "3" in FIG. 2.

Referring initially to FIGS. 1–3, this invention provides a specially designed fuel-fired multi-use water heater production platform or structure 10 which, as will be subsequently described herein, may be directly utilized as a natural draft water heater and may be easily converted for use as (1) a power vented water heater, (2) a natural draft direct vent water heater, or (3) a powered direct vent water heater. The present invention thus desirably eliminates the previous necessity of providing differently configured production platforms for these four different types of water heaters.

The multi-use platform 10 includes a cylindrical metal tank 12, having top and bottom ends 14 and 16, in which a quantity of water 18 to be heated is stored for on-demand delivery to various plumbing fixtures via water inlet and outlet fittings 20,22 on the top of the tank 12. A combustion chamber 24 underlies the bottom end 16 of the tank 12 and has a suitable fuel burner, such as the illustrated gas burner 26, operatively disposed therein. Gas is supplied to the burner 26 via a gas supply pipe 28 in which a control valve (not illustrated), suitable for the specific variety of water heater that incorporates the multi-use platform 10, is installed. A gas supply orifice 29 is connected in the supply pipe 28 and is positioned within the combustion chamber 24 beneath the burner 26 (see FIG. 3).

A combustion gas exhaust flue 30 sequentially extends upwardly from the combustion chamber 24, through the interior of the tank 12, and through the top end 14 of the tank 12. During firing of the water heater formed using the platform 10, hot combustion products 31 formed in the combustion chamber 24 are upwardly exhausted through the flue 30. Combustion heat transferred from the flue 30 is used to heat the stored water 18.

Laterally circumscribing the tank 12 is a metal jacket structure 32 having an upper end section 34 overlying the top end 14 of the tank 12, and a bottom pan portion 35 forming the lower end of the multi-use platform 10. As shown in FIGS. 2 and 3, an annular skirt wall 37 extends downwardly from the bottom side periphery of the combustion chamber 24. The lower end of the annular skirt wall 37 rests on the top side of the bottom pan 35 (see FIG. 1). An upper end portion of the flue 30 extends through a central opening 36 in the upper jacket end section 34. The jacket structure 32 defines an insulation space 38 that circumscribes the tank 12, as may best be seen in FIG. 2, the space 38 being filled with suitable insulation material such as, for example, hardened foam insulation 40 positioned above fiberglass insulation 41 that laterally circumscribes the combustion chamber 24.

A circumferentially spaced pair of openings 42 extend downwardly through the upper jacket end section 34, at its periphery, and communicate with a pair of combustion air flow passages 44 (only one of which is visible in FIGS. 2 and 3) that extend downwardly through the insulation 40,41 between the outer side surface of the tank 12 and the interior side surface of the jacket structure 32. At their lower ends the passages 44 communicate with a circumferentially spaced pair of air collector plenum boxes 46 positioned against exterior side wall portions of the combustion chamber 24, each of the air plenum boxes 46 horizontally extending around only a portion of the circumference of the combustion chamber 24. In turn, the interiors of the plenum boxes 46 communicate with the interior of the combustion chamber 24 via transfer openings 48 formed in the exterior side wall of the combustion chamber 24. The plenum boxes 46 thus define circumferentially widened lower end extensions of the air flow passages 44. During firing of the water heater formed using the multi-use production platform 10, combustion air 50 is drawn into the combustion chamber 24 sequentially via the upper end section openings 42, the combustion air flow passages 44 within the insulation space 38, the interiors of the air plenum boxes 46 and the combustion chamber side wall air transfer openings 48 to support combustion within the combustion chamber 24. The combustion chamber 24 is suitably sealed in a manner such that all of the combustion air entering the combustion chamber passes downwardly through the vertical insulation space air flow passages 44.

The vertical air flow passages 44 may be defined at least in part by suitable vertical air tubes or ducts 52 placed in the insulation space 38 prior to the foaming-in of the insulation 40, and left in place thereafter, or may simply be voids formed in the insulation 40 by, for example, molds disposed within the insulation space 38 during the foaming-in process and later removed from the insulation space 38. Alternatively, the flow passages 44 could be defined in pre-molded rigid insulation inserted into the tank/jacket annulus 38.

As illustrated in FIG. 2, a suitable flapper type check valve member 120 is installed in each of the vertical air flow passages 44, representatively near its upper end, and assumes its solid line horizontal position during non-firing periods of the water heater, thereby substantially preventing undesirable heat dissipating convective updrafts through the air flow passages 44. However, during firing of the water heater, the flapper member 120 is pivoted downwardly to its dotted line position to thereby permit substantially unimpeded downflow of combustion air 50 through the vertical air flow passages 44. Representatively, the flapper member may be of an elastomeric construction, but could be of a variety of alternate constructions if desired.

As best illustrated in FIG. 3, a horizontally oriented radiant heat reflector/air diverter plate structure 122 is suitably supported within the combustion chamber 24 above its bottom wall 124 and the gas discharge orifice 29, and below the burner 26. The plate structure 122 forms with the bottom combustion chamber wall 124 a plenum 126, and a central opening 128 in the plate structure 122 overlies the gas discharge orifice 29. Tab sections 130 of the plate structure 122 extend to vertically intermediate portions of the combustion chamber sidewall openings 48 and generally divide them into upper and lower portions.

During firing of the water heater 10, combustion air 50 passing inwardly through the sidewall openings 48 is split by tabs 130 into a lower portion 50*a* which enters the plenum 126, and an upper portion 50*b* which enters the combustion chamber 24 above the plate structure 122. The lower combustion air portion 50*a* is used as primary air that mixes with fuel discharged from the orifice 20 upwardly through the plate opening 128 to a fuel/air inlet (not visible) on the underside of the burner 26, while the combustion air portion 50*b* is used as secondary air fed to the burner flame above the plate 122. A reflective upper side surface of the plate structure 122 reflects radiant heat from the burner flame upwardly toward the bottom end 16 of the tank 12 to desirably increase the thermal efficiency of the water heater.

Referring again to FIGS. 1–3, the multi-use production platform 10 illustrated therein (after being fitted with an appropriate fuel valve and control system suitable for a natural draft configuration) may be directly utilized as a fuel-fired natural draft water heater 54 by simply associating a vent pipe 56 having a suitable draft hood portion 57 (shown in phantom in FIG. 2) with the upper end of the flue 30.

In this natural draft use of the manufacturing platform 10, ambient combustion air 50 adjacent the water heater 54 is drawn downwardly through the upper jacket inlet openings 42, which are directly exposed to ambient air adjacent the top end of the water heater, into the underlying vertical insulation space flow passages 44. To inhibit entry of debris into the passages 44, suitable screening material (not illustrated) may be placed over the inlet openings 42, with a portion of the air 50 also being drawn into the draft hood 57 for use as dilution air to cool the flue gases 31 being drawn into the vent pipe 56. The positioning of the vertical inlet openings 42 at peripheral locations on the upper jacket end section 34 maximizes their distances from the centrally disposed flue 30 to thereby prevent interference between the flue and combustion air flows.

Using simple conversion apparatus which will now be described, an upper end portion of the multi-use platform 10 may be modified to convert it into a fuel-fired power vented water heater 58 (see FIG. 4), a fuel-fired natural draft direct vent water heater 60 (see FIGS. 5 and 6), or a fuel-fired powered direct vent water heater 62 (see FIGS. 7 and 8). In this manner, the overall manufacturing and tooling costs of such water heaters may be desirably reduced.

Figure 4:
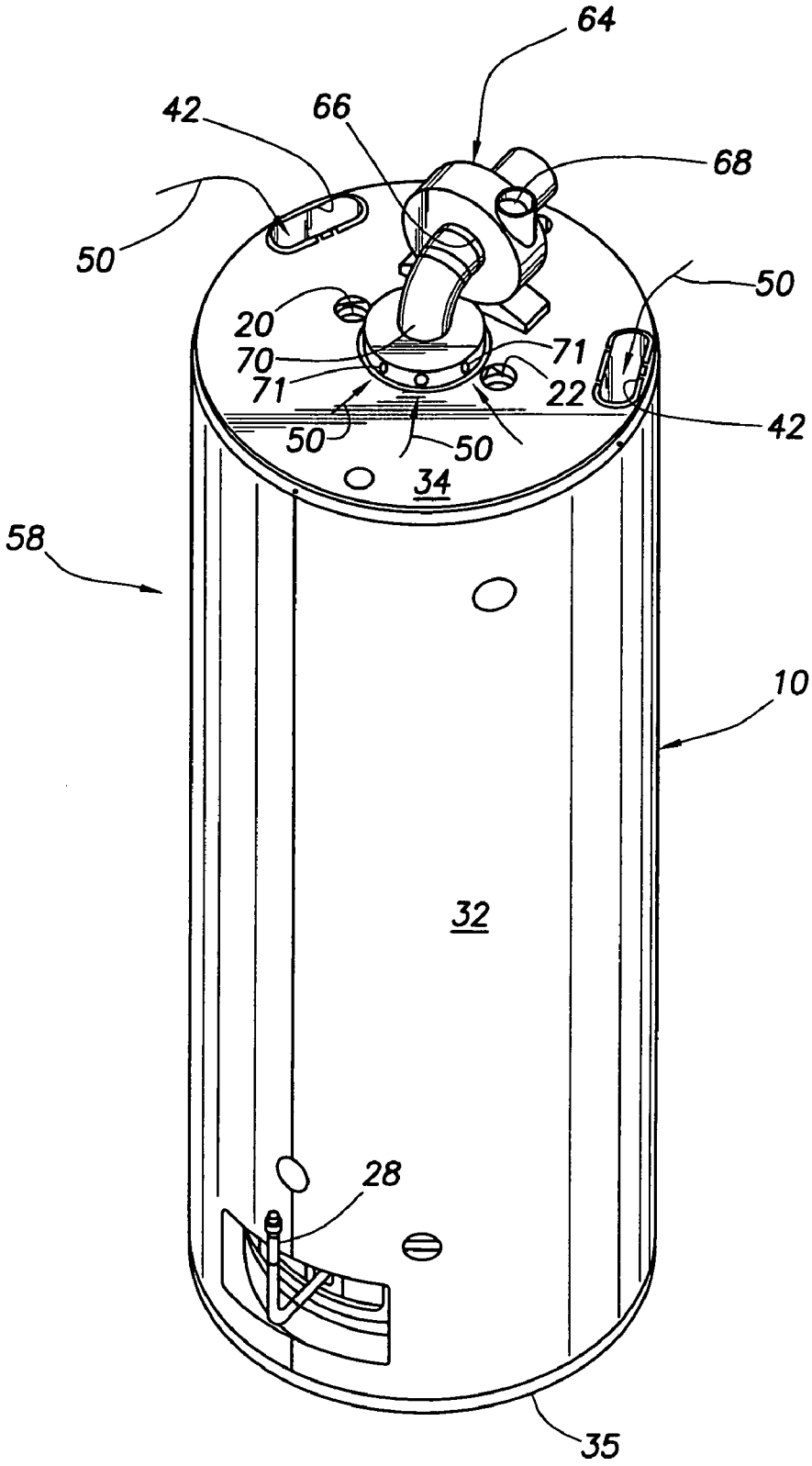
FIG. 4 is a perspective view of the production platform after it has been converted to a power vented water heater subassembly.

Turning now to FIG. 4, the portion of the conversion apparatus used to modify an upper end portion of the multi-use platform 10 and convert the platform 10 into the illustrated power vented water heater 58 includes a draft inducer fan 64 having an inlet 66 and an outlet 68, and an inlet fitting 70 having a spaced series of dilution air inlet openings 71 formed therein. To convert the platform 10 into the illustrated power vented water heater 58, the draft inducer fan 64 is suitably mounted atop the jacket top end section 34, and the fan inlet 66 is suitably coupled to the flue 30 using the inlet fitting 70. The downwardly extending peripheral air inlet openings 42 are left directly exposed to ambient air 50 adjacent the water heater 58 so that during firing of the water heater 58 and operation of the draft inducer fan 64 ambient air 50 is drawn into the inlet openings 42 for delivery to the combustion chamber 24 via the vertical air flow passages 44. As illustrated in FIG. 4, a portion of the ambient air 50 is also drawn into the draft inducer fan inlet fitting openings 71 as cooling dilution air. The inlet openings 42 may be suitably screened to prevent debris from being drawn into the vertical flow passages 44.

Figure 5:
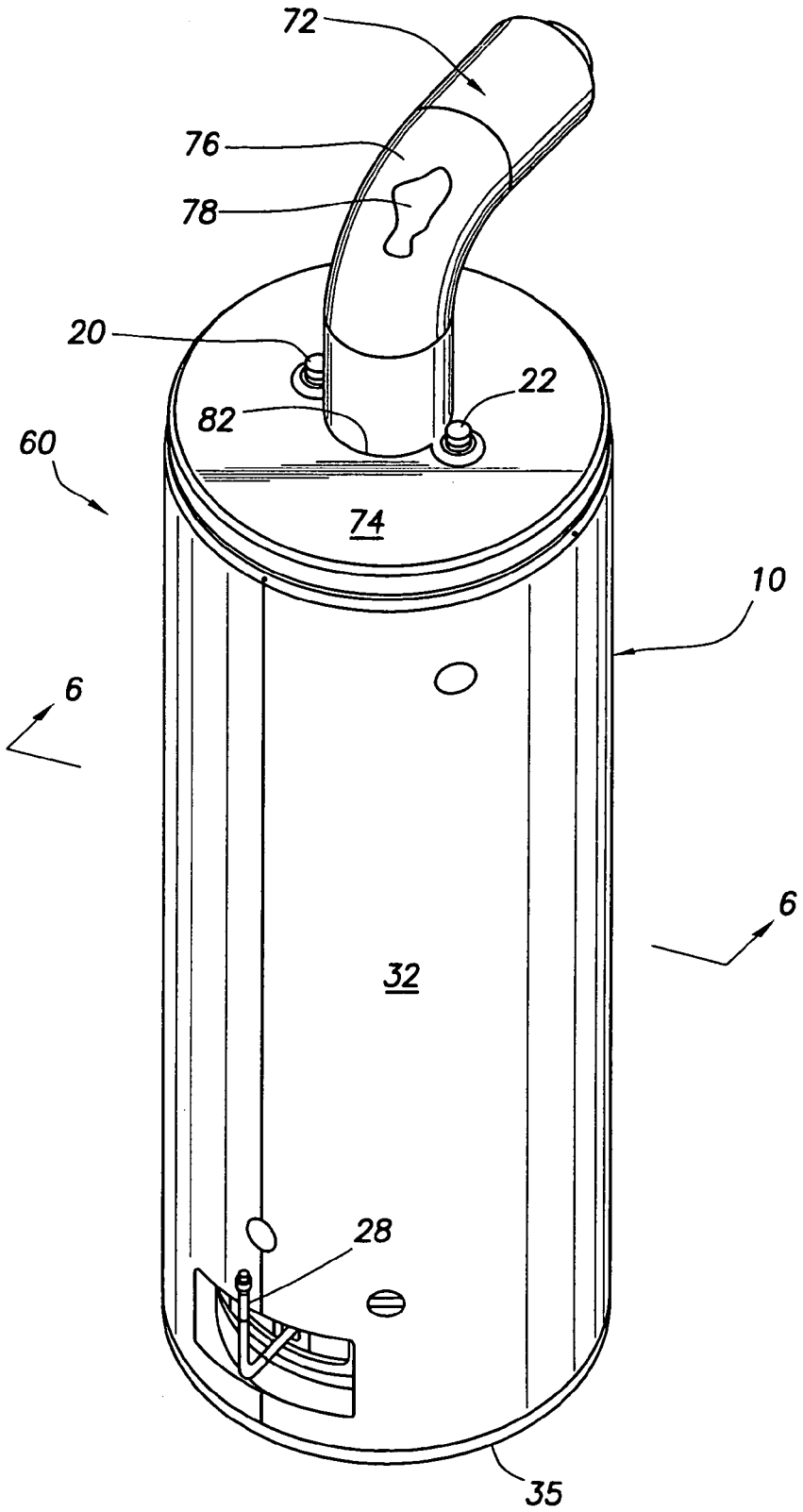
FIG. 5 is a perspective view of the production platform after it has been converted to a direct vent water heater subassembly.
Figure 6:
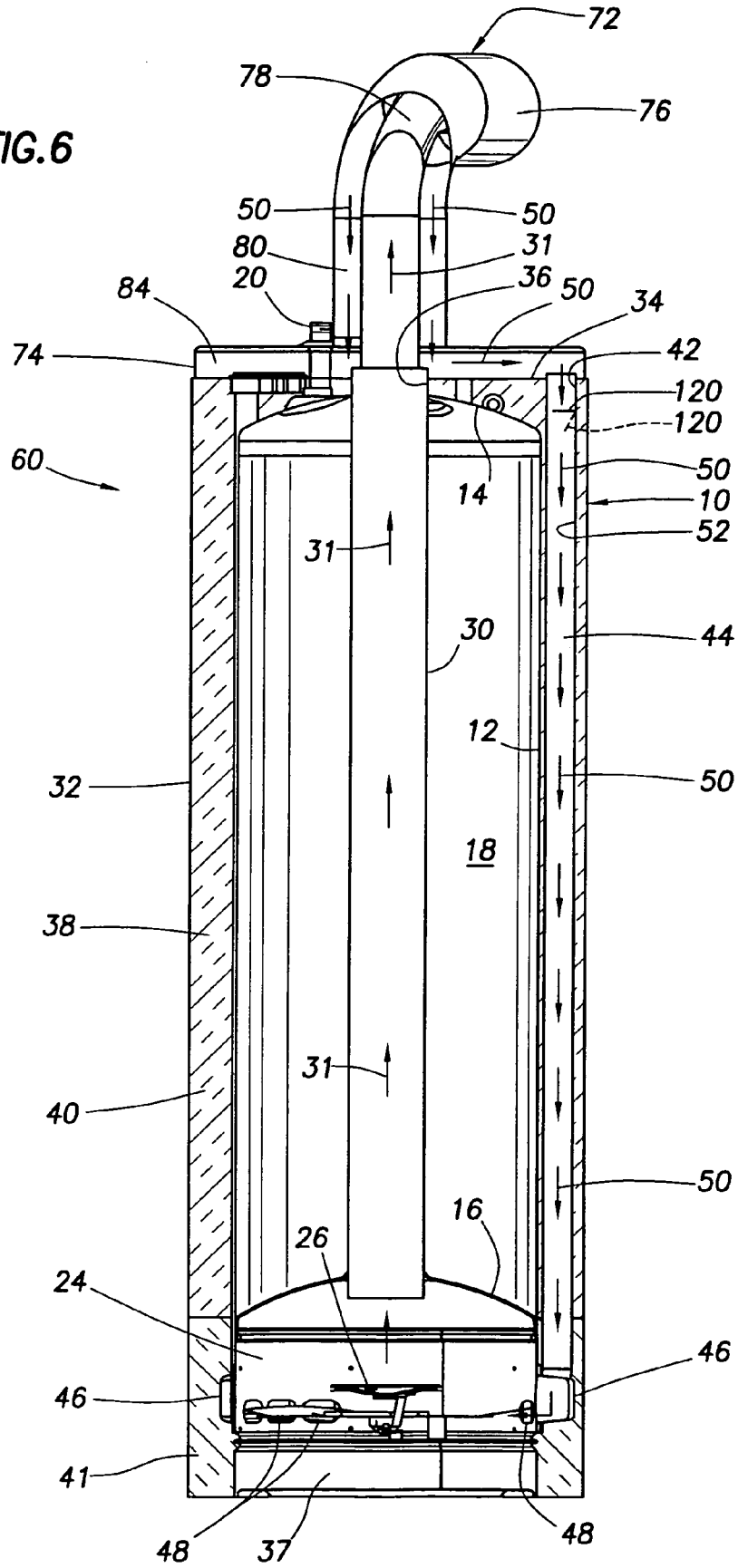
FIG. 6 is a simplified cross-sectional view through the direct vent water heater subassembly taken along line 6—6 of FIG. 5.

The portion of the conversion apparatus used to modify an upper end portion of the multi-use platform 10 and convert the platform 10 into the natural draft direct vent water heater 60 shown in FIGS. 5 and 6 includes a concentric tube structure 72, and a circular cover member 74. Concentric tube structure 72 has an outer combustion air delivery tube 76, a concentric inner vent tube 78, and an annular flow space 80 disposed between the outer and inner tubes 76,78. The circular cover member 74 has a central opening 82 formed therein.

To convert the multi-use platform 10 to the natural draft direct vent water heater 60 shown in FIGS. 5 and 6 (in addition to installing a suitable fuel valve and control system) the cover member 74 is installed on the top end of the platform 10 to form thereon a combustion air plenum 84 overlying the top end section 34 of the jacket structure 32. The concentric tube structure 72 is then connected to the top end of the platform 10 in a manner such that the bottom end of the outer tube 76 is secured to the top side of the cover member 74 over the central opening 82 therein, the annulus 72 communicates with the combustion air plenum 84, and the bottom end of the inner tube 78 is connected to the top end of the flue 30.

During firing of the water heater 60, combustion products 31 traversing the flue 30 are upwardly discharged through the inner tube 78, and remote combustion air 50 is drawn into the vertical air passages sequentially via the annulus 80, the plenum 84 and the top end air inlet openings 42.

Figure 7:
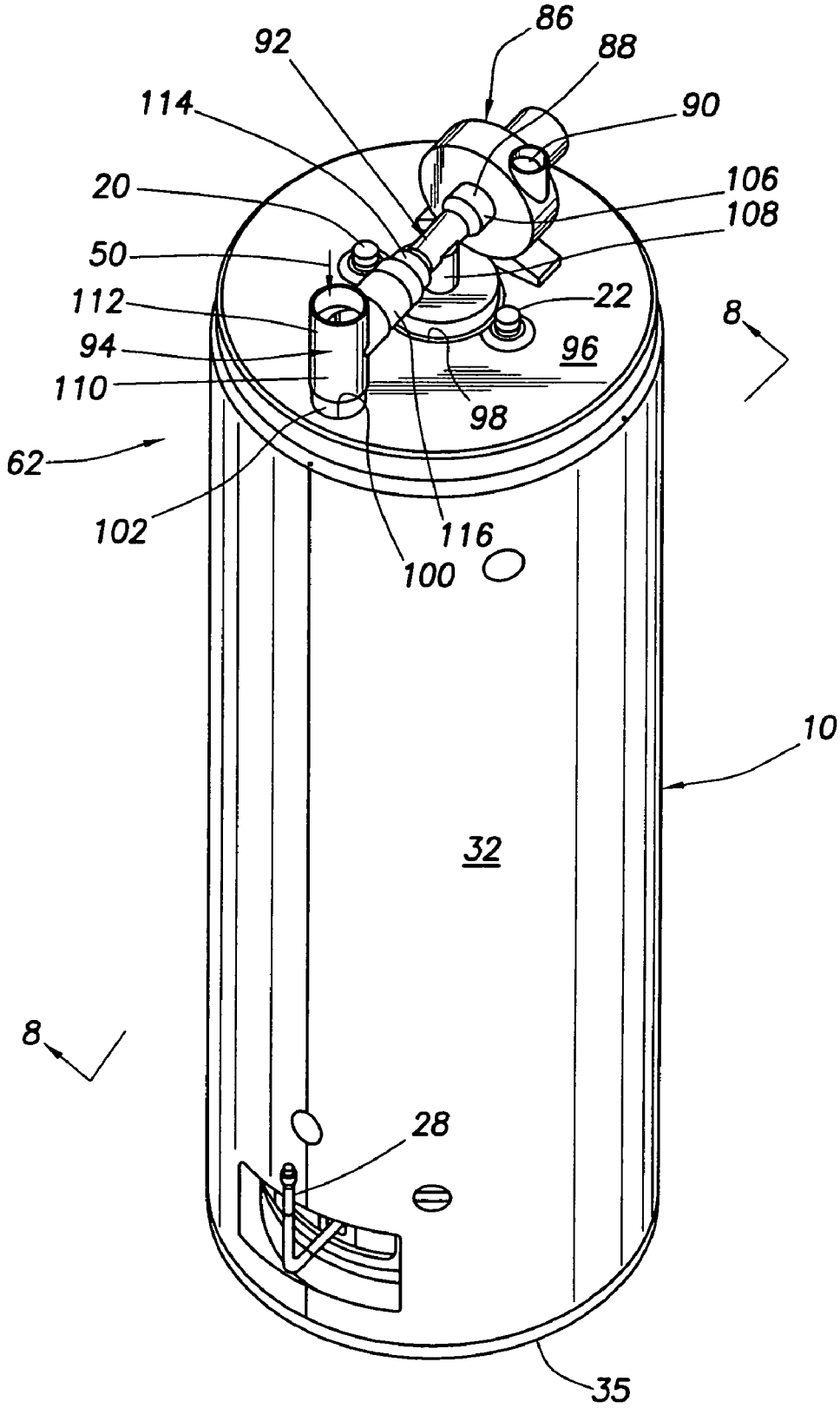
FIG. 7 is a perspective view of the production platform after it has been converted to a powered direct vent water heater subassembly.
Figure 8:
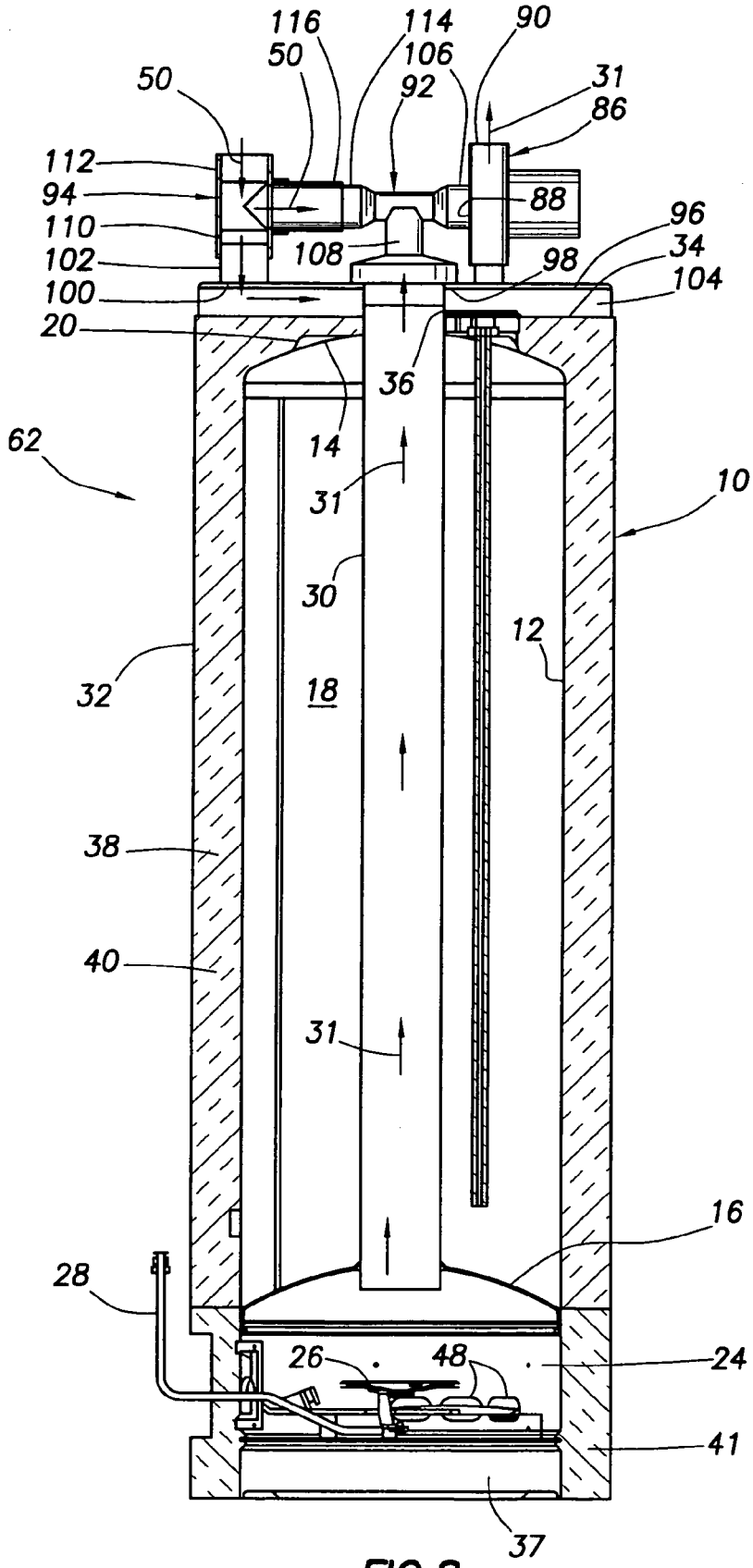
FIG. 8 is a simplified cross-sectional view through the powered direct vent water heater subassembly taken along line 8—8 of FIG. 7.

The portion of the conversion apparatus used to modify an upper end portion of the multi-use platform 10 and convert the platform 10 into the powered direct vent water heater 62 shown in FIGS. 7 and 8 includes a draft inducer fan 86 having an inlet 88 and an outlet 90, a hollow flow structure representatively in the form of an interconnected pair of hollow tee structures 92 and 94, and a circular cover member 96. The top side of the cover member 96 has a central opening 98, and a radially outer opening 100 from which a tubular stub member 102 upwardly projects.

To convert the multi-use platform 10 to the powered direct vent water heater 62 shown in FIGS. 7 and 8 (in addition to installing a suitable fuel valve and control system) the cover member 96 is installed on the top end of the platform 10 to form thereon a combustion air plenum 104 overlying the top end section 34 of the jacket structure 32 and the draft inducer fan 86 is suitably mounted atop the cover member 96. A first leg 106 of the tee structure 92 is coupled to the fan inlet 88, and a laterally enlarged, downwardly projecting second leg 108 of the tee structure 92 is coupled to the top side of the cover member 96 over its central opening 98. A first leg 110 of the hollow tee structure 94 is coupled to the stub member 102, with a second leg 112 of the tee structure 94 facing upwardly. This second tee leg 112 may be connected to a suitable combustion air intake conduit (not shown) extending to a remote source of combustion air 50. The third legs 114,116 of the tees 92,94 are interconnected to one another as shown.

During firing of the water heater 62, and operation of the draft inducer fan 86, air 50 is drawn downwardly through the legs 110,112 of tee 94, enters the plenum 104 and is then delivered to the combustion chamber 24 via the vertical air flow passages 44. At the same time, combustion products 31 exiting the flue 30 are drawn upwardly through the tee leg 108 and into the fan inlet 88 via the tee leg 106. These combustion products are cooled by a portion of the incoming combustion air 50 drawn through the interconnected tee legs 114,116 toward the fan inlet 88.

Figure 9:
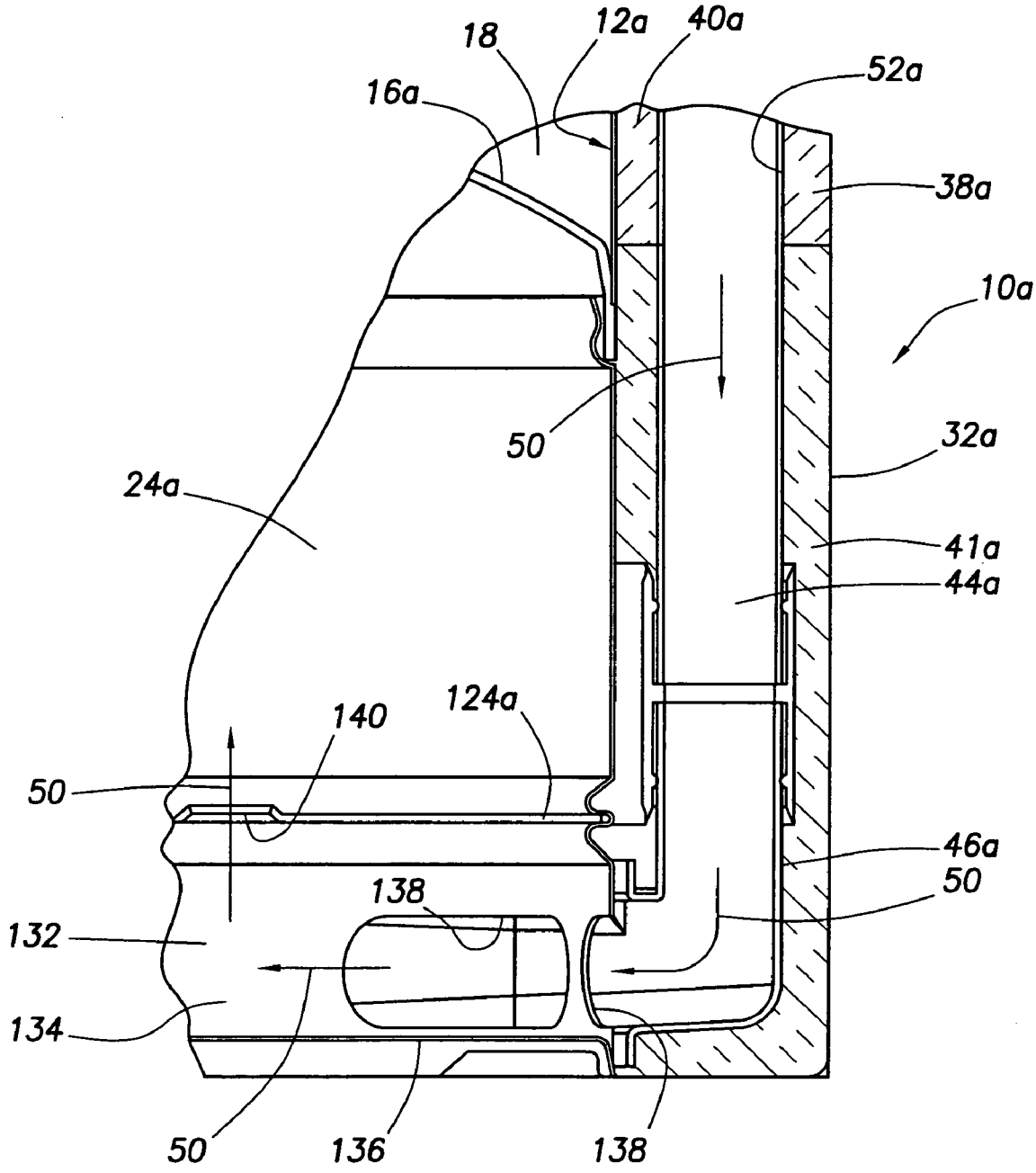
FIG. 9 is a simplified cross-sectional view through a lower end portion of a first alternate embodiment of the production platform shown in FIG. 1.

A lower end portion of a first alternate embodiment 10*a* of the previously described fuel-fired multi-use water heater production platform 10 is illustrated in simplified cross-sectional form in FIG. 9. For ease in comparing the platforms 10 and 10*a*, illustrated components in the platform 10*a* similar to components in the previously described platform 10 have been given identical reference numerals to which the subscripts "a" have been added.

With reference to FIG. 9, the platform 10*a* is similar to the previously described platform 10 with the exceptions (in the illustrated lower end portion of the platform 10*a*) that (1) the combustion air 50 downwardly traversing the vertical passages 44*a* in the insulation space 38*a* is not delivered to the combustion chamber 24*a* through openings in its vertical side wall portion as in the case of the module 10, and (2) the previously described radiant heat reflector/air diverter plate structure 122 (see FIG. 3) is eliminated, with the bottom combustion chamber wall 124*a* being used as a radiant heat reflector plate (the wall 124*a* having a heat reflective top side surface) to upwardly reflect combustion heat onto the bottom end 16*a* of the tank 12*a* during firing of the water heater in which the platform 10*a* is incorporated.

In the first alternate production platform embodiment 10*a* shown in FIG. 9, the previously described annular skirt wall 37 (see FIG. 2) is used to define an enclosed combustion air transfer plenum 132 which is disposed beneath the combustion chamber 24*a* and has an annular side wall 134, a bottom wall 136 spaced downwardly apart from the combustion chamber 24*a*, and an upper wall defined by the bottom wall 124*a* of the combustion chamber 24*a*. A circumferentially spaced series of air transfer openings 138 are formed in the plenum side wall 134, and a spaced series of air transfer and distribution openings 140 (only one of which is visible in FIG. 9) are formed through the bottom combustion chamber wall 124*a*. As illustrated, the side wall air transfer openings 138 communicate with the interiors of the air plenum boxes 46*a*.

During firing of the water heater in which the production platform 10*a* is incorporated, combustion air 50 sequentially flows downwardly through the vertical air flow passages 44*a* (representatively defined at least in part by the vertical ducts 52*a*), the interiors of the air plenum boxes 46*a*, into the combustion air plenum 132 via its side wall openings 138, through the plenum 132, and upwardly into the combustion chamber 24*a* through the air transfer openings 140 in the bottom combustion chamber wall 124*a*. The spaced apart air transfer openings 140 serve to horizontally "spread" the combustion air 50 entering the combustion chamber 24*a* to more evenly distribute the combustion chamber 24*a* horizontally in the combustion chamber 24*a*.

Figure 10:
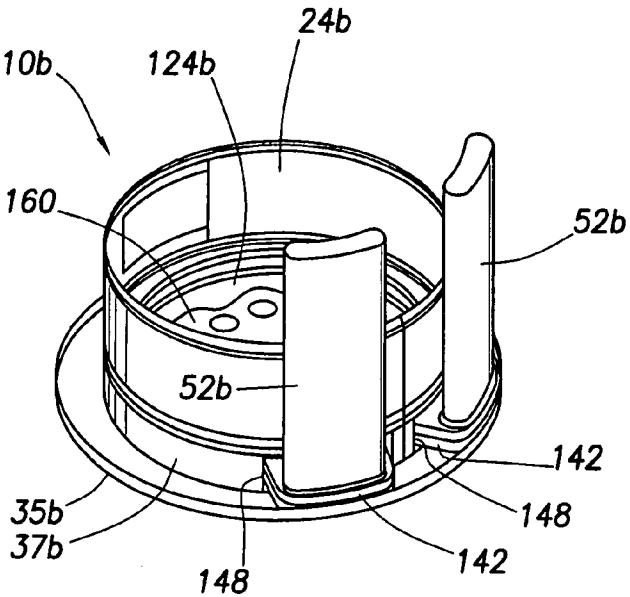
FIG. 10 is a perspective view of a lower end portion of a second alternate embodiment of the production platform shown in FIG. 1, the tank, jacket and other portions of the second embodiment having been removed for illustrative clarity.
Figure 14:
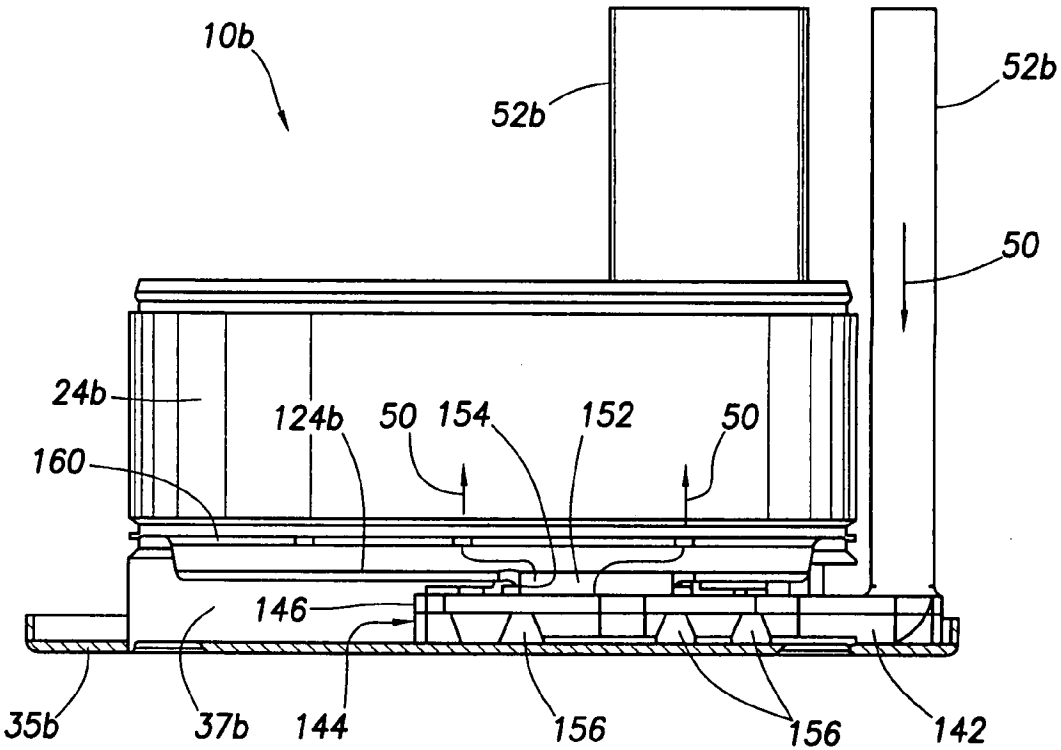
FIG. 14 is an enlarged scale simplified cross-sectional view through the FIG. 13 lower production platform end portion along line 14—14 thereof.
Figure 13:
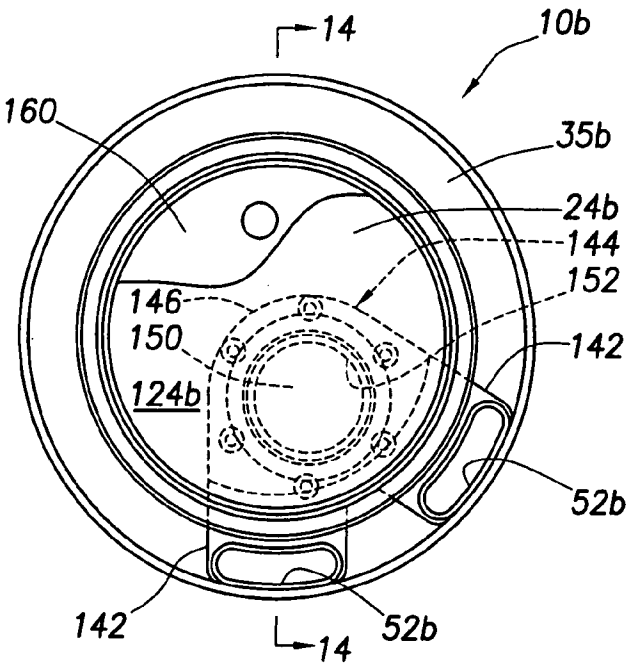
FIG. 13 is a top plan view of the lower production platform end portion shown in FIG. 10.

A lower end portion of a second alternate production platform embodiment 10*b* is illustrated in FIGS. 10, 13 and 14. Platform 10*b* is similar to the previously described platform 10*a* with the primary exception (in the illustrated lower end portion of the platform 10*b*) that, as will now be described, different structure is utilized for delivering combustion air to the combustion chamber. For ease in comparing the platforms 10*a* and 10*b*, illustrated components in the platform 10*b* similar to components in the previously described platform 10*a* have been given identical reference numerals to which the subscripts "b" have been added.

In the production platform embodiment 10*b*, the vertically extending combustion air intake ducts 52*b* that are positioned in the jacket/tank insulation space are connected at their lower ends to the top sides of outer ends of two leg portions 142 of a flat, generally V-shaped air plenum box structure 144 having an apex section 146. Apex section 146 is disposed within the interior of the annular skirt wall 37*b*, in an underlying relationship with the bottom wall 124*b* of the combustion chamber 24*b*, with the outer ends of the leg portions 142 (to which the lower ends of the ducts 52*b* are connected) horizontally extending outwardly through openings 148 in the skirt wall 37*b* (see FIG. 10).

Figure 11:
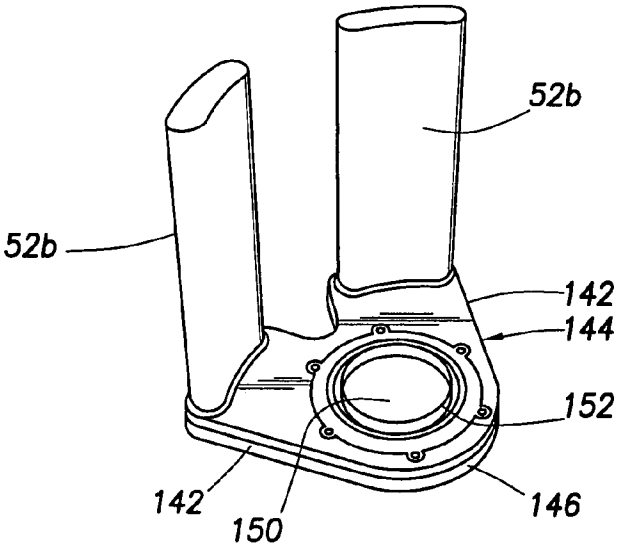
FIG. 11 is a top side perspective view of a specially designed air plenum box structure utilized in the second alternate production platform embodiment.
Figure 12:
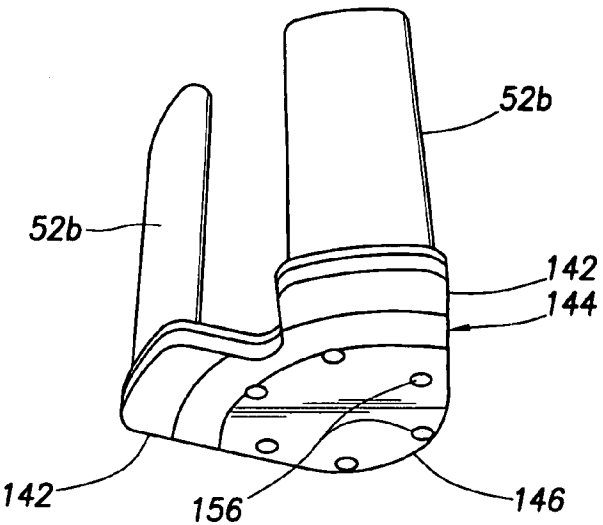
FIG. 12 is a bottom side perspective view of the air plenum structure shown in FIG. 11.

The top side of the apex section 146 of the air plenum box structure 144 has an outlet opening 150 formed therein and bordered by an upstanding annular connection flange 152 (see FIGS. 11 and 13). Flange 152 is sealingly received in a circular opening 154 formed in the otherwise unperforated bottom combustion chamber wall 124*b* (see FIG. 14). The apex section 146 of the air plenum box structure 144 is secured to the bottom combustion chamber side wall 124*b* by sheet metal screws (not shown) extending upwardly through tapered fastening wells 156 (see FIGS. 12 and 14) extending upwardly through the bottom side of the apex section 146 into its interior. During firing of the platform 10*b*, combustion air 50 (see FIG. 14) flows downwardly through the vertical air flow passage representatively defined by the ducts 52*b*, horizontally through the air plenum box structure 144, and then upwardly into the combustion chamber 24*b* via the annular connection flange 152.

A perforated air distribution plate 160 (see FIGS. 10, 13 and 14) is horizontally supported within the combustion chamber 24*b* below the burner therein (not illustrated) in an upwardly spaced relationship with the bottom combustion chamber wall 124*b*. Combustion air 50 entering the combustion chamber 24*b* via its opening 154 is caused to flow horizontally and then upwardly through the perforations in the plate 160 to thereby provide more even horizontal distribution of the entering combustion air 50.

Figure 15:
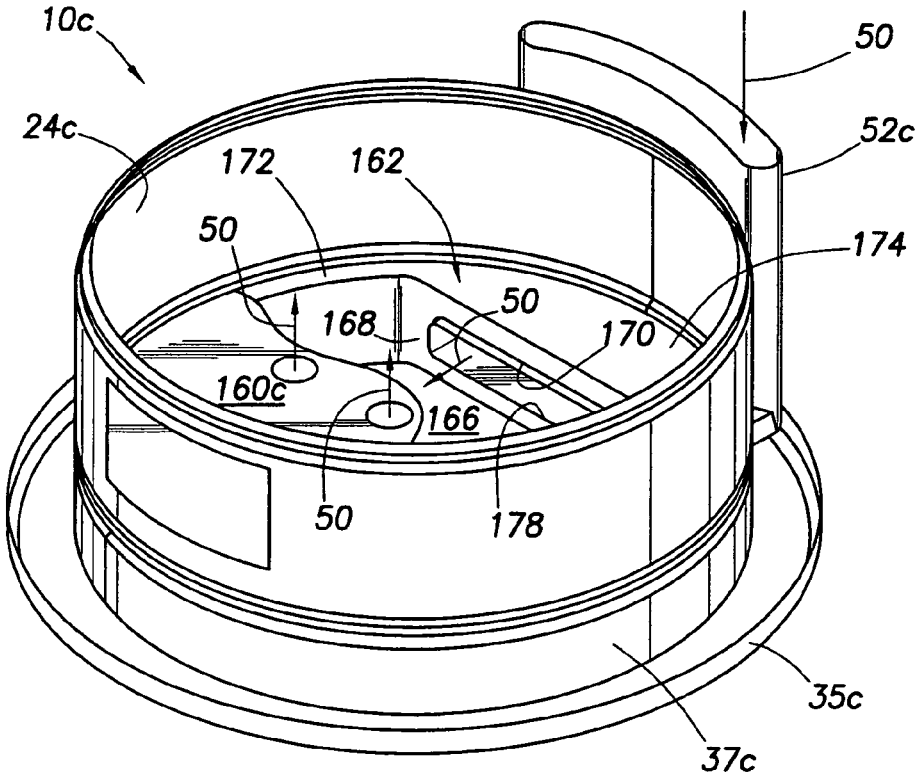
FIG. 15 is a partially cut away perspective view of a lower end portion of a third alternate embodiment of the production platform shown in FIG. 1, the tank, jacket and other portions of the third embodiment having been removed for illustrative clarity.
Figure 16:
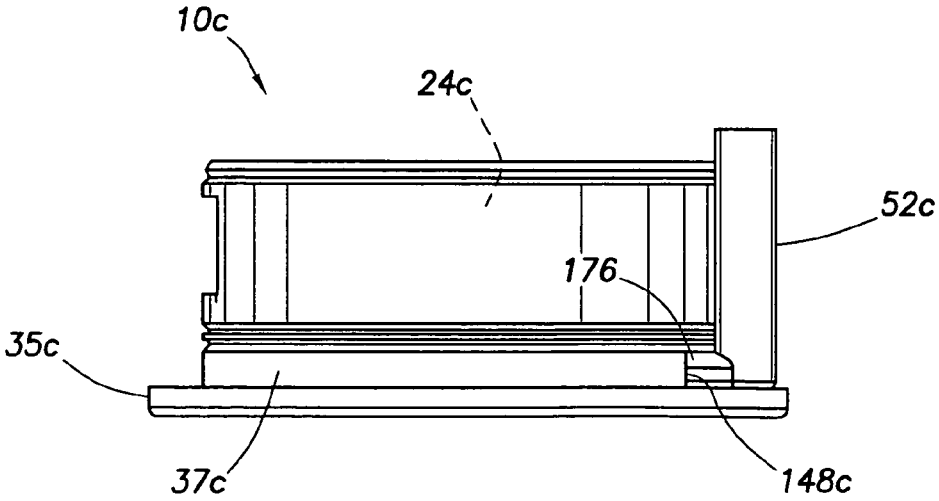
FIG. 16 is a reduced scale right side elevational view of the lower production platform end portion shown in FIG. 15.
Figure 17:
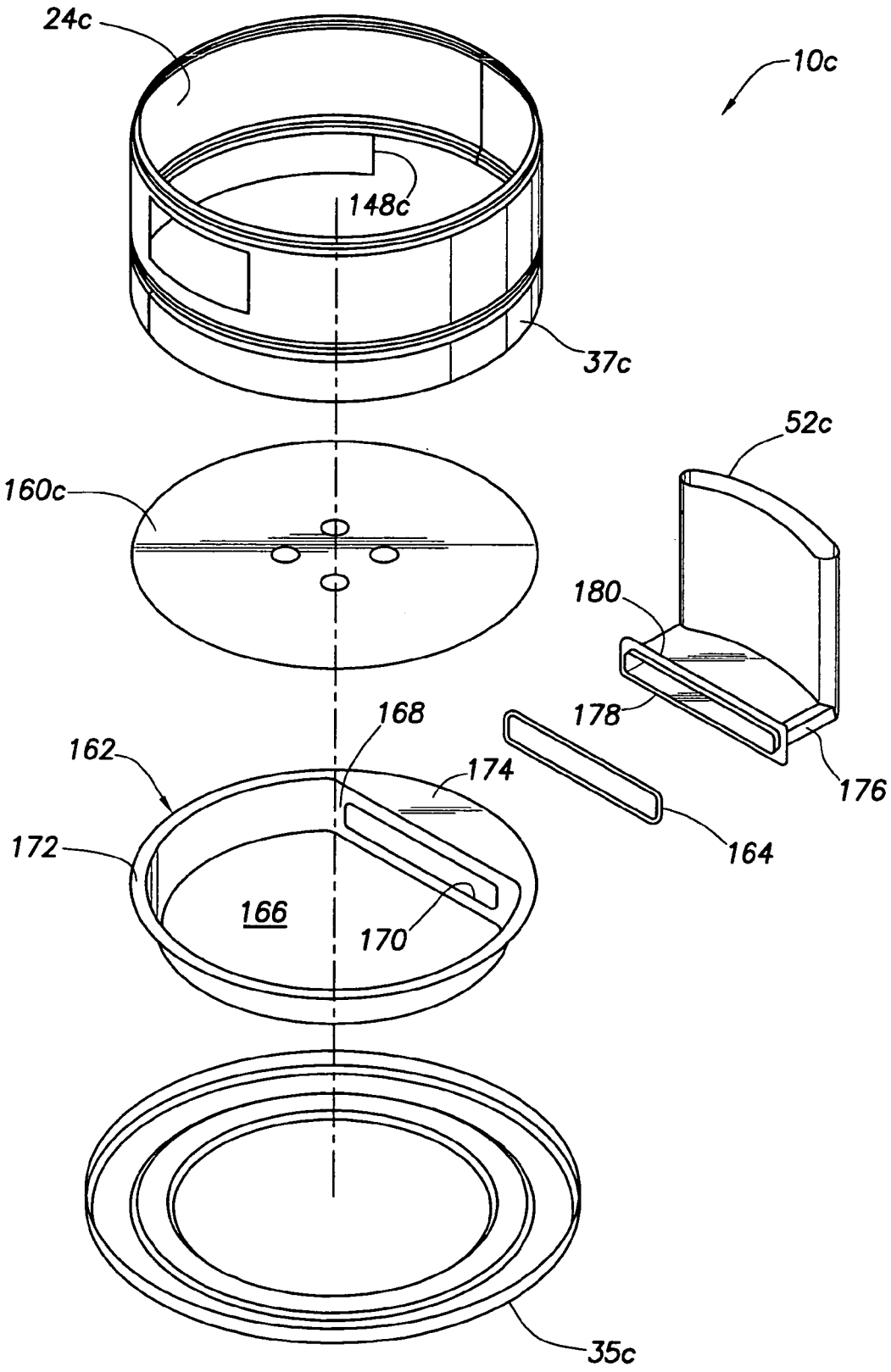
FIG. 17 is a reduced scale exploded perspective view of the lower production platform end portion shown in FIG. 15.

A lower end portion of a third alternate production platform embodiment 10*c* is illustrated in FIGS. 15–17. Platform 10*c* is similar to the previously described platform 10*b* with the primary exception (in the illustrated lower end portion of the platform 10*c*) that, as will now be described, different structure is utilized for delivering combustion air to the combustion chamber. For ease in comparing the platforms 10*b* and 10*c*, illustrated components in the platform 10*c* similar to components in the previously described platform 10*b* have been given identical reference numerals to which the subscripts "c" have been added.

As best illustrated in FIG. 17, the depicted lower end portion of the production platform 10*c* includes a combustion chamber 24*c* from a lower end of which the annular skirt wall 37*c* depends, a perforated circular air distribution plate 160*c*, a plenum pan 162, the bottom pan 35*c*, the vertical air duct 52*c*, and an elongated rectangular resilient sealing gasket 164. Plenum pan 162 has a bottom wall 166, a flattened vertical side wall portion 168 in which a horizontally elongated rectangular opening 170 is formed, and a top side flange 172 having a widened portion 174 projecting horizontally outwardly from the side wall portion 168. The vertical duct 52*c*, which is disposed in the platform's insulation space, has a transverse bottom end portion 176 with an open outer end 178 bordered by an inwardly offset, horizontally elongated rectangular mounting flange 180.

In the assembled lower end portion of the platform 10*c* shown in FIGS. 15 and 16, the plenum pan 162 is horizontally supported in the combustion chamber 24*c* with the bottom wall 166 of pan 162 forming the bottom wall of the combustion chamber 24*c*, the pan side wall opening 170 being aligned with the circumferentially extending side opening 148*c* in the skirt wall 37*c* (see FIG. 17), and the perforated air distribution plate 160*c*, being supported atop the pan flange 172. The bottom end portion 176 of the vertical duct 52*c* extends through the circumferential skirt wall opening 148*c* (see FIGS. 15 and 16), with the open outer end 178 of the duct portion 176 extending into the pan opening 170 through the gasket 164, and the duct end flange 180 being secured to the pan side wall 168 by, for example, screws (not illustrated).

During firing of the water heater in which the production platform 10*c* is incorporated, combustion air 50 (see FIG. 15) sequentially flows downwardly through the insulation space duct 52*c*, horizontally through the bottom duct end portion 176 into the interior of the plenum pan 162 beneath the perforated air distribution plate 160*c*, and then upwardly through the perforations in the plate 160*c* into an upper portion of the combustion chamber 24*c* for combustion therein by the burner (not shown).

In the simple manners previously described herein, the same fuel-fired water heater production platform 10 (or the platform 10*a*, 10*b* or 10*c* as the case may be) may be directly utilized as a natural draft water heater, or converted by modifying a top end portion thereof to a power vented water heater, a natural draft direct vent water heater, or a powered direct vent water heater, thereby permitting desirable reductions in the tooling and manufacturing costs for these different types of water heaters.

The foregoing detailed description is to be clearly understood as being given by way of illustration and example only, the spirit and scope of the present invention being limited solely by the appended claims.

What is claimed is:

1. Water heating apparatus comprising:

a fuel-fired water heater structure including a tank adapted to hold a quantity of water to be heated and having top and bottom ends, a jacket structure extending around said tank and defining therewith an insulation space that laterally circumscribes said tank, said jacket structure having a horizontal top end section extending over said top end of said tank and having a first opening and a second opening each extending downwardly through said top end section of said jacket structure, insulation disposed in said insulation space and extending between the outer side surface of said tank and the inner side surface of said jacket structure, a combustion chamber disposed beneath said bottom end of said tank, a fuel burner disposed within said combustion chamber, a flue extending from said combustion chamber, through the interior of said tank, to said first opening, and a combustion air intake passage extending through said insulation and intercommunicating said second opening and said combustion chamber, said fuel-fired water heater structure being useable as a natural draft water heater having a ready-to-use configuration in which said second opening is directly exposed to ambient air adjacent a top end portion of the natural draft water heater; and conversion apparatus, connectable to an upper end portion of said fuel-fired water heater structure, for converting said fuel-fired water heater structure to a selectively variable one of a power vented water heater structure, a natural draft direct vent water heater structure, and a powered direct vent water heater structure.

2. The water heating apparatus of claim 1 wherein:

said first opening is a central opening, and said second opening is a peripheral opening.

3. The water heating apparatus of claim 1 wherein:

said combustion air intake passage is at least partially defined by a duct extending vertically through said insulation.

4. The water heating apparatus of claim 1 wherein:
said combustion chamber has a vertical exterior side wall with an opening extending therethrough,
said fuel-fired water heater structure further includes an air plenum box disposed in said insulation space and horizontally extending around a circumferential exterior portion of said combustion chamber side wall, the interior of said air plenum box communicating with the interior of said combustion chamber through said side wall opening in said combustion chamber, and
said combustion air intake passage intercommunicates said second opening and the interior of said air plenum box.

5. The water heating apparatus of claim 4 wherein:
said air intake plenum box, relative to said combustion chamber, has a circumferential width greater than that of said combustion air intake passage.

6. The water heating apparatus of claim 1 further comprising a check valve structure disposed in said combustion air intake passage and operative to substantially preclude upward fluid flow therethrough.

7. The water heating apparatus of claim 6 wherein:
said check valve structure includes a resilient flapper member.

8. The water heating apparatus of claim 1 further comprising:
a plate structure horizontally disposed within said combustion chamber between a bottom portion thereof and said burner and forming with said bottom portion an air diversion plenum beneath said plate structure, said plate structure being operative to divide combustion air entering said combustion chamber through said side wall opening therein into a primary combustion air portion flowing through said air diversion plenum to said burner, and a secondary combustion air portion flowing above said plate structure to said burner.

9. The water heating apparatus of claim 8 wherein:
said plate structure has a radiant heat reflective upper side surface.

10. The water heating apparatus of claim 1 wherein:
said selectively variable one of a power vented water heater structure, a natural draft direct vent water heater structure, and a powered direct vent water heater structure is a power vented water heater structure, and
said conversion apparatus includes a draft inducer fan having an inlet connectable to said flue at said first opening.

11. The water heating apparatus of claim 10 wherein:
said draft inducer fan is disposed on the upper end of said fuel-fired water heater structure, with said inlet of said draft inducer fan being connected to said flue at said first opening, and said second opening being directly exposed to ambient air adjacent a top end portion of said fuel-fired water heater structure.

12. The water heating apparatus of claim 1 wherein:
said selectively variable one of a power vented water heater structure, a natural draft direct vent water heater structure, and a powered direct vent water heater structure is a direct vent water heater structure, and
said conversion apparatus includes a cover member having a third opening therein and being securable to an upper end portion of said fuel-fired water heater structure in a manner such that said cover member forms a combustion air intake plenum overlying said horizontal upper end section of said jacket structure with said third opening overlying said first opening.

13. The water heating apparatus of claim 12 wherein:
said cover member is secured to an upper end portion of said fuel-fired water heater structure.

14. The water heating apparatus of claim 13 wherein:
said conversion apparatus further includes a concentric tube structure having an inner vent tube outwardly surrounded by an outer combustion air tube forming around said inner vent tube a combustion air passageway, said concentric tube structure being operatively connectable to an upper end portion of said fuel-fired water heater structure in a manner such that said inner vent tube is coupled to said flue, and said combustion air passageway communicates with said combustion air intake plenum.

15. The water heating apparatus of claim 14 wherein:
said concentric tube structure is operatively connected to an upper end portion of said fuel-fired water heater structure.

16. The water heating apparatus of claim 1 wherein:
said selectively variable one of a power vented water heater structure, a natural draft direct vent water heater structure, and a powered direct vent water heater structure is a powered direct vent water heater structure, and
said conversion apparatus includes:
a cover member having third and fourth openings therein and being securable to an upper end portion of said fuel-fired water heater structure in a manner such that said cover member forms a combustion air intake plenum overlying said horizontal upper end section of said jacket structure with said third opening overlying said first opening,
a draft inducer fan having an inlet, and
a hollow flow structure connectable to said cover member at said third and fourth openings and operative to intercommunicate said flue and said combustion air intake plenum with said inlet of said draft inducer fan, said hollow flow structure having a combustion air inlet opening for receiving combustion air for delivery to the combustion air intake plenum.

17. The water heating apparatus of claim 16 wherein:
said cover member is secured to an upper end portion of said fuel-fired water heater structure,
said draft inducer fan is mounted on said cover member, and
said hollow flow structure operatively intercommunicates said fan inlet with said flue and said combustion air intake plenum.

18. The water heating apparatus of claim 1 wherein:
said combustion chamber has a bottom wall with an air transfer opening extending therethrough,
said fuel-fired water heater structure further includes a combustion air plenum extending downwardly from said bottom wall of said combustion chamber and having a vertical side wall with an air transfer opening therein, and an air plenum box disposed in said insulation space and horizontally extending around a circumferential exterior portion of said side wall of said combustion air plenum, the interior of said air plenum box communicating with the interior of said combustion air plenum through said side wall air transfer opening thereof, and
said combustion air intake passage intercommunicates said second opening and the interior of said air plenum box.

19. The water heating apparatus of claim 1 wherein:
said combustion chamber has a bottom wall with an air transfer opening extending therethrough,
said fuel-fired water heater structure further includes an annular skirt wall depending from a bottom periphery of said combustion chamber and having an opening extending therethrough, an air plenum box structure extending inwardly through said skirt wall opening and having an outlet opening connected to said air transfer opening, and an inlet, and said air intake passage intercommunicates said second opening and said inlet of said air plenum box structure.

20. The water heating apparatus of claim 19 wherein:

said inlet of said air plenum box structure is positioned horizontally outwardly of said annular skirt wall, and said combustion air inlet passage is defined by a vertical duct extending between said second opening and said inlet of said air plenum box structure.

21. The water heating apparatus of claim 19 further comprising:

a perforated air distribution plate disposed in said combustion chamber above said bottom wall thereof.

22. The water heating apparatus of claim 1 wherein:

said fuel-fired water heater structure further includes an annular skirt wall depending from a bottom periphery of said combustion chamber and having an opening extending therethrough, a plenum pan structure disposed within the interior of said annular skirt wall and having a bottom wall defining the bottom wall of said combustion chamber, and said air intake passage intercommunicates said second opening and the interior of said plenum pan structure.

23. The water heating apparatus of claim 22 wherein:

said combustion air inlet passage is defined by a vertical duct extending between said second opening and the interior of said plenum pan structure.

24. The water heating apparatus of claim 23 wherein:

said vertical duct is connected to a vertical side wall portion of said plenum pan structure.

25. The water heating apparatus of claim 22 further comprising:

a perforated air distribution plate horizontally supported within said combustion chamber above said bottom wall of said plenum pan structure.

26. A water heater manufacturing method comprising the steps of:

fabricating a fuel-fired water heater structure useable as a natural draft water heater and having:

a tank adapted to hold a quantity of water to be heated, a jacket structure extending around said tank and defining therewith an insulation space that laterally circumscribes said tank, said jacket structure having a horizontal top end section extending over said top end of said tank and having first and second openings therein, insulation disposed in said insulation space and extending between the outer side surface of said tank and the inner side surface of said jacket structure, a combustion chamber disposed beneath said bottom end of said tank and having a fuel burner operatively associated therewith, a flue extending from said combustion chamber, through the interior of said tank, to said first opening, and a combustion air intake passage extending through said insulation and intercommunicating said second opening and said combustion chamber; and providing conversion apparatus, connectable to an upper end portion of said fuel-fired water heater structure, for converting said fuel-fired water heater structure to a selectively variable one of a power vented water heater structure, a natural draft direct vent water heater structure, and a powered direct vent water heater structure.

27. The method of claim 26 wherein:

said selectively variable one of a power vented water heater structure, a natural draft direct vent water heater structure, and a powered direct vent water heater structure is a power vented water heater structure, and said providing step includes the step of providing a draft inducer fan having an inlet connectable to said flue at said first opening.

28. The method of claim 27 further comprising the steps of:

positioning said draft inducer fan on the upper end of said fuel-fired water heater structure, and connecting said inlet of said draft inducer fan to said flue at said first opening.

29. The method of claim 26 wherein:

said selectively variable one of a power vented water heater structure, a direct vent water heater structure, and a powered direct vent water heater structure is a direct vent water heater structure, and said providing step includes the step of providing a cover member having a third opening therein and being securable to an upper end portion of said fuel-fired water heater structure in a manner such that said cover member forms a combustion air intake plenum overlying said horizontal upper end section of said jacket structure with said third opening overlying said first opening.

30. The method of claim 29 further comprising the step of:

securing said cover member to an upper end portion of said fuel-fired water heater structure.

31. The method of claim 30 wherein:

said providing step further includes the step of providing a concentric tube structure having an inner vent tube outwardly surrounded by an outer combustion air tube forming around said inner vent tube a combustion air passageway, said concentric tube structure being operatively connectable to an upper end portion of said fuel-fired water heater structure in a manner such that said inner vent tube is coupled to said flue, and said combustion air passageway communicates with said combustion air intake plenum.

32. The method of claim 31 further comprising the step of:

operatively connecting said concentric tube structure to an upper end portion of said fuel-fired water heater structure.

33. The method of claim 26 wherein:

said selectively variable one of a power vented water heater structure, a direct vent water heater structure, and a powered direct vent water heater structure is a powered direct vent water heater structure, and said providing step includes the steps of providing a cover member securable to an upper end portion of said fuel-fired water heater structure in a manner such that said cover member forms a combustion air intake plenum overlying said horizontal upper end section of said jacket structure, providing a draft inducer fan having an inlet, and providing a hollow flow structure operatively interconnectable between said draft inducer fan inlet and said cover member in a manner intercommunicating said fan inlet with said flue and said combustion air intake plenum, said hollow flow structure having a passage through which combustion air may flow into said combustion air intake plenum.

34. The method of claim 33 further comprising the steps of:

securing said cover member to an upper end portion of said fuel-fired water heater structure, and operatively connecting said hollow flow structure to said cover member and said inlet of said draft inducer fan.

* * * * *